US009166334B1

(12) United States Patent
Huang et al.

(10) Patent No.: US 9,166,334 B1
(45) Date of Patent: Oct. 20, 2015

(54) SLIDE CONNECTOR, SLIDE SOCKET AND ELECTRONIC DEVICE FOR ELECTRICAL CONNECTING WITH SLIDE CONNECTOR

(71) Applicant: Chicony Electronics Co., Ltd., New Taipei (TW)

(72) Inventors: Wei-Cheng Huang, New Taipei (TW); Mei-Yi Tsai, New Taipei (TW); Wei-Ming Chiu, New Taipei (TW); Pei-Sheng Tsai, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 14/250,715

(22) Filed: Apr. 11, 2014

(51) Int. Cl.

| | |
|---|---|
| ***H01R 13/629*** | (2006.01) |
| ***H01R 33/00*** | (2006.01) |
| ***H01R 13/627*** | (2006.01) |
| ***H01R 13/24*** | (2006.01) |

(52) U.S. Cl.
CPC ..... *H01R 13/629* (2013.01); *H01R 13/24* (2013.01); *H01R 13/6271* (2013.01); *H01R 33/00* (2013.01)

(58) Field of Classification Search
USPC ..... 439/350, 352, 259, 357, 374, 179
See application file for complete search history.

(56) References Cited

U.S. PATENT DOCUMENTS

| | | | | | |
|---|---|---|---|---|---|
| 4,775,327 | A * | 10/1988 | Normann et al. | ..... | 439/140 |
| 4,904,213 | A * | 2/1990 | Hock et al. | ..... | 439/824 |
| 4,946,395 | A * | 8/1990 | Cope et al. | ..... | 439/352 |
| 5,829,997 | A * | 11/1998 | Okano et al. | ..... | 439/310 |
| 6,790,064 | B2 * | 9/2004 | Kajiwara | ..... | 439/259 |
| 6,878,016 | B2 * | 4/2005 | Wulff et al. | ..... | 439/700 |
| 6,910,911 | B2 * | 6/2005 | Mellott et al. | ..... | 439/358 |
| 7,553,193 | B2 * | 6/2009 | Kast et al. | ..... | 439/660 |
| 8,956,178 | B2 * | 2/2015 | Chen | ..... | 439/374 |
| 8,993,153 | B2 * | 3/2015 | Bacon et al. | ..... | 429/179 |

* cited by examiner

*Primary Examiner* — Alexander Gilman
(74) *Attorney, Agent, or Firm* — Chun-Ming Shih; HDLS IPR Services

(57) ABSTRACT

An electronic device comprises includes a housing, a slide socket and a slide connector. The slide socket has a sliding slot and a plural of conductive pads. The slide connector includes a main body, a slider and a plural of elastic conductive terminals. The elastic conductive terminals are combined in the main body and partially exposed out of a surface of the slider, wherein the elastic conductive terminals slide into the sliding slot for electrical connecting with the conductive pads through the slider. Thus the slide connector electrically connects with the electronic device through a simple method of sliding. Therefore a gap caused from vibration will be avoided and an electrical connection failure will be decreased.

23 Claims, 4 Drawing Sheets

SLIDE CONNECTOR, SLIDE SOCKET AND ELECTRONIC DEVICE FOR ELECTRICAL CONNECTING WITH SLIDE CONNECTOR

BACKGROUND OF THE INVENTION

1. Field of the Invention

The present invention generally relates to electrical connectors and, in particular to slide connectors, slide sockets and electronic devices with the slide connectors.

2. Description of Prior Art

Nowadays electronic imaging devices such as digital cameras or webcams have become essential electronic products in life. Due to a popularity of the internet and social networking sites, users use electronic imaging devices very often and capture images by the electronic imaging devices. Therefore, there is a required demand of using the shoot images immediately. Thus how to achieve an electrically connection between electronic the devices and other electronic devices for transmitting data through a simple way is a research motivation of the present inventor.

Moreover, when external connectors electrically connect with the electronic imaging devices, a displacement will occur between the connectors and sockets if the electronic imaging devices is suddenly moved by accident, an interrupt of electrical connection may occur and a data lost may happen when the interrupt occur during the data transmitting.

In view of the above drawbacks, the Inventor proposes the present invention based on his expert knowledge and elaborate researches in order to solve the problems of prior art.

SUMMARY OF THE INVENTION

Accordingly, an object of the present invention is to provide a slide connector, a slide socket and an electronic device for electrical connecting with slide connector, in which the slide connector electrically connect with the slide socket by a method of sliding for combining both quickly.

Accordingly, another object of the present invention is to provide a slide connector, a slide socket and an electronic device with slide connector, in which the slide connector electrically connect with the slide socket by a method of sliding, therefore a gap caused from vibration will be avoided and an electrical connection failure will be decreased.

In order to achieve the object mentioned above, the present invention provides a slide connector for electrical connecting with a slide socket having a sliding slot. The slide connector comprises a main body, a slider disposed on a lateral side of the main body and a plural of elastic conductive terminals. The elastic conductive terminals are combined in the main body and partially exposed out of a surface of the slider, wherein the elastic conductive terminals slide into the sliding slot for electrical connecting with the slide socket in a slide connecting direction through the slider.

In order to achieve the object mentioned above, the present invention provides a slide socket for electrical connecting with a slide connector having a slider. The slide socket comprises a sliding slot and a plural of conductive pads are disposed in the sliding slot, wherein the conductive pads slide into the sliding slot for electrical connecting with the slide connector in a slide connecting direction through the slider.

In order to achieve the object mentioned above, the present invention provides an electronic device for electrical connecting with a slide connector. The electronic device comprises includes a housing, a slide socket disposed in the housing and a slide connector. The slide socket has a sliding slot and a plural of conductive pads are disposed in the sliding slot. The slide connector includes a main body, a slider disposed on a lateral side of the main body and a plural of elastic conductive terminals. The elastic conductive terminals are combined in the main body and partially exposed out of a surface of the slider, wherein the elastic conductive terminals slide into the sliding slot for electrical connecting with the conductive pads in a slide connecting direction through the slider.

Another object of the present invention is to provide a slide connector, a slide socket and an electronic device with slide connector, in which the width of the opening is provided corresponding to the width of the sliding end, and the width of the other end of the slide connector is larger for avoiding a reverse insertion of the slide connector. Thus a foolproof function will be achieved.

Another object of the present invention is to provide a slide connector, a slide socket and an electronic device with slide connector, in which the first power terminal of the slide connector contacts the second grounding terminal and the second data terminal of the slide socket in turn and contacts the second power terminal at last. Thus electrical connecting functions such as power supplying, grounding, and data transmitting will be achieved.

Comparing to the prior art, the electronic device comprises a slide socket having a sliding slot and a plural of conductive pads are disposed in the sliding slot. In another aspect, the slide connector having elastic conductive terminals slide into the sliding slot for electrical connecting with the conductive pads. The slide connector electrically connects with the electronic device through a simple method of sliding, therefore a gap caused from vibration will be avoided and an electrical connection failure will be decreased.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
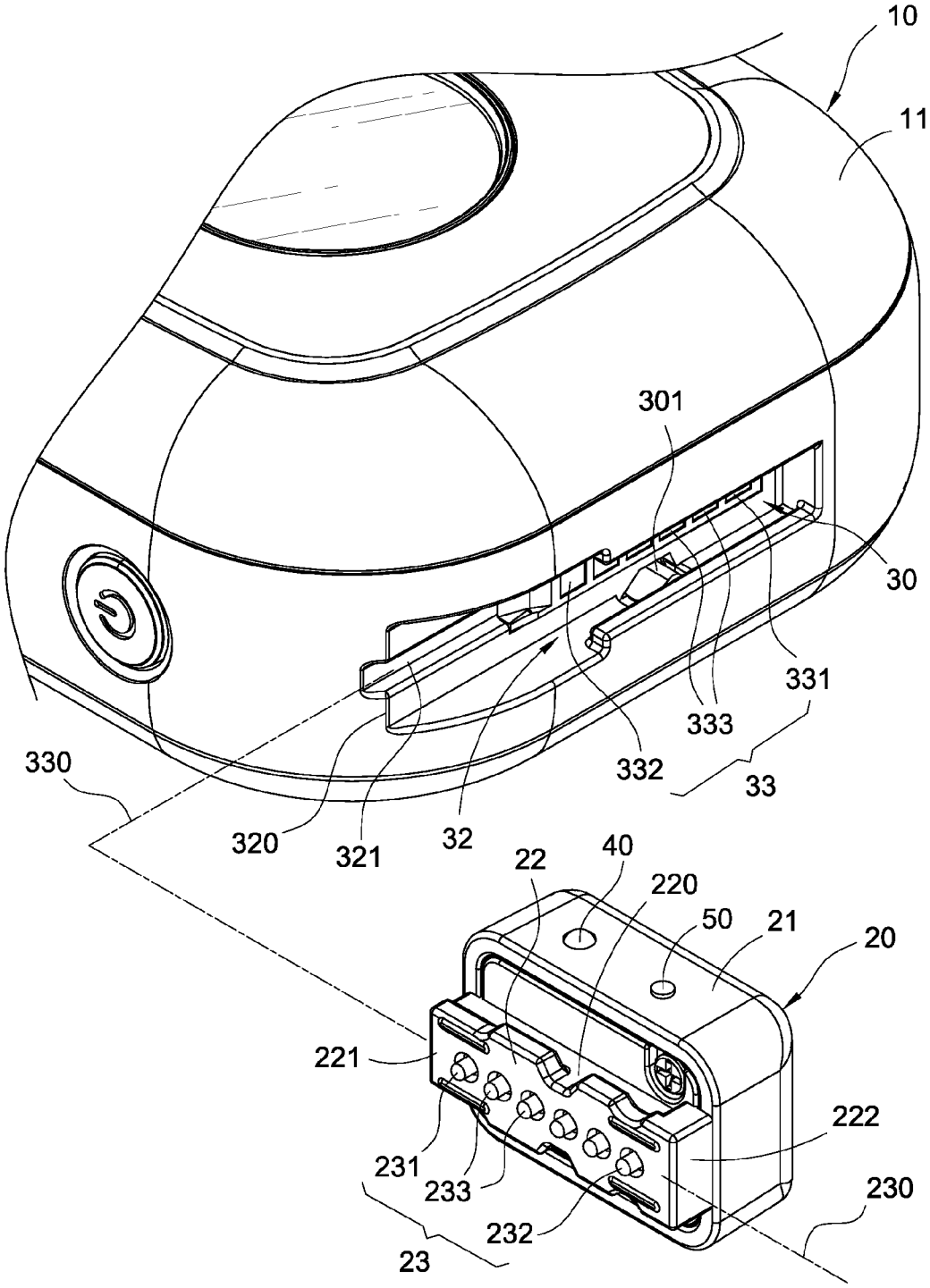
FIG. 1 is an application schematic view of an electronic device for electrical connecting with a slide connector of the present invention.
Figure 2:
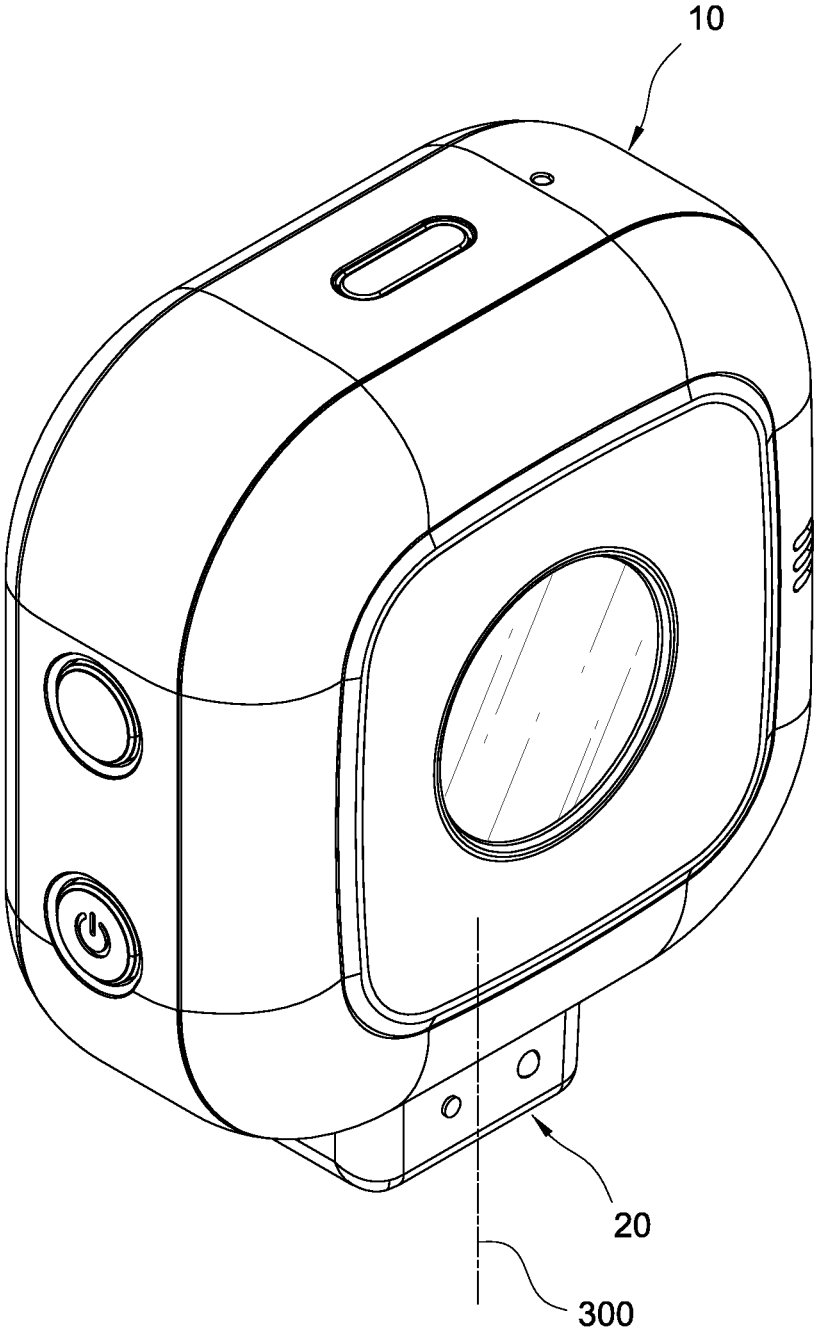
FIG. 2 is a perspective schematic view of an electronic device for electrical connecting with a slide connector of the present invention.

Please refer to FIG. 1 and FIG. 2, which depict an application schematic view and a perspective schematic view of an electronic device for electrical connecting with a slide connector. The present invention provides an electronic device 10 for electrical connecting with a slide connector. The electronic device 10 is provided with a slide socket 30 for connecting with a slide connector 20, and an electrical connection is achieved between the electronic device 10 and the slide connector 20.

The electronic device 10 includes a housing 11, and the slide socket 30 is disposed in the housing 11. The slide socket 30 has a sliding slot 32 and a plural of conductive pads 33 are disposed in the sliding slot 32. In an embodiment of the present invention, the sliding slot 32 and the housing are formed in one piece form. Furthermore, the slide connector 20 includes a main body 21, a slider 22 disposed on a lateral side of the main body 21 and a plural of elastic conductive terminals 23. The elastic conductive terminals 23 are combined in the main body 21 and partially exposed out of a surface of the slider 22.

The elastic conductive terminals 23 slide into the sliding slot 32 of the slide socket 30 for electrical connecting with the conductive pads 33 through the slider 22 in a slide connecting direction 200. Thus the electronic device 10 and the slide connector 20 will be electrically connected, and the electronic device 10 can be fixed together with slide connector 20 for preventing misalignment due to vibration, then an electrical connection failure can be avoided. In an embodiment of the present invention, the electronic device 10 is, but not limited to, a camera.

In the present invention, a fixing component 301 is projected out of the sliding slot 32 of the slide socket 30. The fixing component 301 can be, but not limited to, a metal hook. The sliding slot 22 of the slide connector 20 has a positioning slot 220 corresponding to the fixing component 301, and the fixing component 301 is positioned in the positioning slot 220. Structures of the slide connector 20 and the slide socket 30 are described as following.

The slider 22 of the slide connector 20 has a sliding end 221 and a stopping end 222 oppositely. The slider 22 slides into the sliding slot 32 of the slide socket 30 from the sliding end 221 along the slide connecting direction 200. The slide connecting direction 200 is perpendicular with a combining direction 300 of the slide socket 30 combining with the slide connector 20. Furthermore, the conductive pads 33 are arranged in a line and have a line direction 23. The elastic conductive terminals 23 are also arranged in a line and have a line direction 230. The slide connecting direction 200 is parallel to the two slide connecting directions 330, 230 of the conductive pads 33 and the elastic conductive terminals 23.

Moreover, an opening 320 is provided at a lateral side of the sliding slot 32. When the slider 22 slides into the sliding slot 32, the stopping end 222 is stopped at the opening 320. Preferably, the width of the opening 320 is provided corresponding to the width of the sliding end 221, and the width of the sliding end 221 is smaller than the width of the stopping end 222. Therefore, the slide connector 20 will not slide into the slide socket 30 from the stopping end for achieving a foolproof function.

It is worth notice that the sliding slot 32 further includes a move-over slot 321, and a depth of the move-over slot 321 is provided corresponding to an exposing out height of the elastic conductive terminals 23. The move-over slot 321 is provided for avoiding damages of the elastic conductive terminals 23 during the sliding process.

In an embodiment, the elastic conductive terminals 23 of the slide connector 20 include a first grounding terminal 231, a first power terminal 232 and at least one first data terminal 233. The first data terminal 233 is disposed between the first grounding terminal 232 and the first power terminal 231. The first power terminal 231 is arranged in a side closing to the sliding end 221, and the first grounding terminal 232 is arranged in a side closing to the stopped end 222.

Similarly, the conductive pads 33 of the slide socket 30 also include a second power terminal 331, a second grounding terminal 332, and at least one second data terminal 333. The second data terminal 333 is disposed between the second power terminal 331 and the second grounding terminal 332. The second grounding terminal 332 is arranged in a side closing to the opening 320 (an outermost side of the sliding slot 32), and the second power terminal 331 is arranged in a side away from the opening 320 (an innermost side of the sliding slot 32).

In an embodiment of the present, the electronic device 10 can electrically connect with the slide connector 20 during operation. Because the second power terminal 331 has a voltage during the operation of the electronic device 10, the terminal having a voltage will cause a short circuit and damages for the conductive pads 33 contacting with the elastic conductive terminals 23 in the process of sliding. With the above configuration, when the slider 22 slides into the sliding slot 32 of the slide socket 30 from the sliding end 221, each conductive pad 33 contacts every elastic conductive terminal 23 in turn. In other words, the first power terminal 231 of the slide connector 20 will contact the second grounding terminal 332 and the second data terminal 333 of the slide socket 30 in turn at first, and the second power terminal 331 will be connected at last. Thus electrical connecting functions such as power supplying, grounding, and data transmitting will be achieved.

In summary, the second power terminal 331 having a voltage will process electrical connection when the slider 22 is positioned in the sliding slot 32 of the slide socket 30 by above configuration. In a condition of that the electronic device 10 connects with the slider 20, a short circuit and damages will not happen when the conductive pads 33 contact with the elastic conductive terminals 23, thus the electronic device 10 and the slider 20 have a hot swapping/hot plugging function. On the contrary, if the slide connector 20 has a voltage, then the first power terminal 231 is arranged in a side closing to the stopped end 222 and the second power terminal 331 is arranged in a side closing the opening 320 (an outermost side of the sliding slot 32). In this way, the first power terminal 231 having a voltage will electrically connect with the second power terminal 331 when the first power terminal 231 is positioned in the sliding slot 32 of the slide socket 30. The above description is an embodiment of the present invention; it is not limited in real practice.

Figure 3:
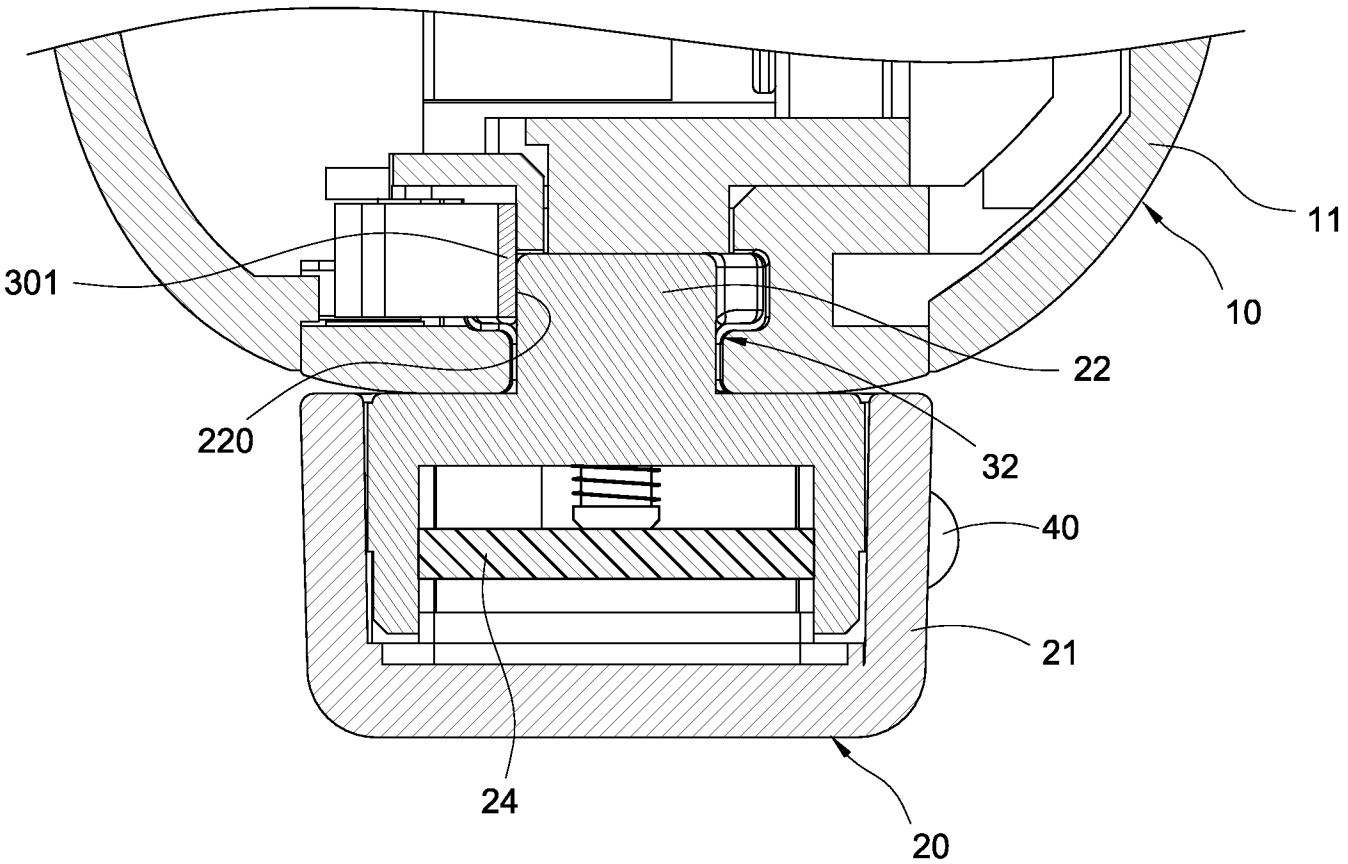
FIG. 3 is a cross sectional view of an electronic device for electrical connecting with a slide connector of the present invention.
Figure 4:
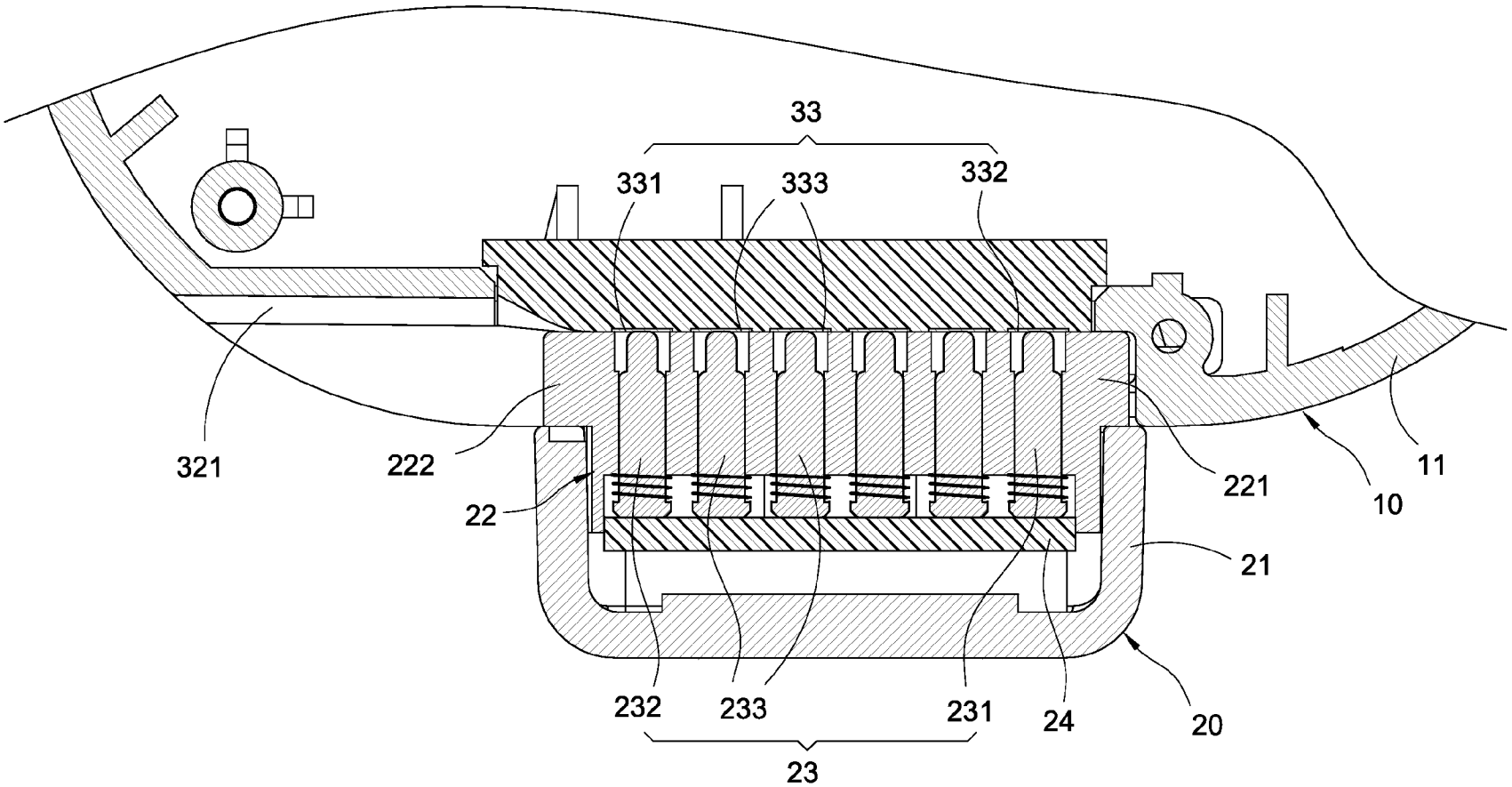
FIG. 4 is another cross sectional view of an electronic device for electrical connecting with a slide connector of the present invention.

Please further refer to FIG. 3 and FIG. 4, which depict two sides of cross sectional views of an electronic device for electrical connecting with a slide connector. After the slide connector 20 sliding into the slide socket 30 for combining with the electronic device 10, the elastic conductive terminals 23 will connect with conductive pads 33, and the slide connector 20 will electrically connect with the electronic device 10. In the present invention, the elastic conductive terminals 23 are, but not limited to, pogo pins. The elastic conductive terminals 23 will electrically connect with a circuit board 24 of the slide connector 20 after compressing, and the circuit board 24 can also electrically connect with other electronic components for achieving design functions.

In an embodiment of the present invention, a light emitting element 40 and a temperature sensor 50 (refer to FIG. 1) are provided on the main body 21 of the slide connector 20. Hence, when the slide connector 20 electrically connects with the electronic device 10, the electronic device 10 provides power to the slide connector 20 and the circuit board 24 from the slide socket 30. Then the circuit board 24 can supply power to the light emitting element 40 and temperature sensor 50, and light emitting element 40 can emit light. Additionally, the temperature sensor 50 can sense an external temperature and the sensed temperature values will be transmitted to the conductive pads 33 through the circuit board 24 and the elastic conductive terminals 23, and the data finally transmitted the electronic device 10 through the slide socket 30. The electronic device 10 will operate by following the received data.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A slide connector for electrical connecting with a slide socket having a sliding slot, the slide connector comprising a main body, a slider disposed on a lateral side of the main body and a plural of elastic conductive terminals, the elastic conductive terminals combined in the main body and partially exposed out of a surface of the slider, wherein the elastic conductive terminals slide into the sliding slot for electrical connecting with the slide socket in a slide connecting direction through the slider, wherein the slide connecting direction is perpendicular with a combining direction of the slide socket combining with the slide connector, the sliding slot has disposed a plural of conductive pads, the conductive pads and the elastic conductive terminals are arranged correspondingly in a line and have a line direction, the line direction is parallel to the slide connecting direction.

2. The slide connector according to claim 1, wherein a fixing component is projected out of the sliding slot, the sliding slot has a positioning slot corresponding to the fixing component and the fixing component is positioned in the positioning slot.

3. The slide connector according to claim 1, wherein the slider has a sliding end and a stopping end oppositely, the slider slides into the sliding slot from the sliding end and is stopped at an opening of the sliding slot, the width of the opening is provided corresponding to the width of the sliding end and the width of the sliding end is smaller than the width of the stopping end.

4. The slide connector according to claim 1, wherein each conductive pad contacts every elastic conductive terminal in turn.

5. The slide connector according to claim 3, wherein the elastic conductive terminals include a first grounding terminal, a first power terminal and at least one first data terminal, and the first data terminal is disposed between the first grounding terminal and the first power terminal.

6. The slide connector according to claim 5, wherein when the conductive pad corresponding to the first power terminal has a voltage, the first power terminal is arranged in an end closing to the sliding end, and the first grounding terminal is arranged in a side closing to the stopping end.

7. The slide connector according to claim 5, wherein when the first power terminal has a voltage, the first power terminal is arranged in a side closing to the stopping end, and the first grounding terminal is arranged in a side closing to the sliding end.

8. A slide socket for electrical connecting with a slide connector having a slider, the slide socket comprising a sliding slot and a plural of conductive pads disposed in the sliding slot, wherein the conductive pads slide into the sliding slot for electrical connecting with the slide connector in a slide connecting direction through the slider, and wherein the slide connecting direction is perpendicular with a combining direction of the slide socket combining with the slide connector, the slide connector has a plural of elastic conductive terminals, the elastic conductive terminals and the conductive pads are arranged correspondingly in a line and have a line direction respectively, the two line directions are parallel to the slide connecting direction.

9. The slide socket according to claim 8, wherein the slider has a positioning slot and the slide socket further includes a fixing component, the fixing component is projected at a lateral side of the sliding slot, and the fixing component is positioned in the positioning slot.

10. The slide socket according to claim 8, wherein an opening is provided at a lateral side of the sliding slot, and the slider has a sliding end and a stopping end oppositely, the slider slides into the sliding slot from the sliding end and the stopping end is stopped at the opening, the width of the opening is provided corresponding to the width of the sliding end, and the width of the sliding end is smaller than the width of the stopping end.

11. The slide socket according to claim 8, wherein each conductive pad contacts every elastic conductive terminal in turn.

12. The slide socket according to claim 10, wherein the conductive pads include a second grounding terminal, a second power terminal and at least one second data terminal, and the at least one second data terminal is disposed between the second grounding terminal and the second power terminal.

13. The slide socket according to claim 12, wherein when the second power terminal has a voltage, the second grounding terminal is arranged in a side closing to the opening, and the second power terminal is arranged in a side away from the opening.

14. The slide socket according to claim 12, wherein when the second power terminal corresponding to the conductive terminal has a voltage, the second grounding terminal is arranged in a side away from the opening, and the second power terminal is arranged in a side closing to the opening.

15. The slide socket according to claim 8, wherein the sliding slot further includes a move-over slot, the slide connector has a slider, the elastic conductive terminals are partially exposed out of a surface of the slider, and a depth of the move-over slot is provided corresponding to an exposing out height of the elastic conductive terminals.

16. An electronic device for electrical connecting with a slide connector, comprising:

an electronic device including a housing;

a slide socket disposed in the housing, the slide socket having a sliding slot and a plural of conductive pads disposed in the sliding slot; and a slide connector including a main body, a slider disposed on a lateral side of the main body and a plural of elastic conductive terminals, the elastic conductive terminals combined in the main body and partially exposed out of a surface of the slider, wherein the elastic conductive terminals slide into the sliding slot for electrical connecting with the conductive pads in a slide connecting direction through the slider, wherein the slide connecting direction is perpendicular with a combining direction of the slide socket combining with the slide connector, the elastic conductive terminals and the conductive pads are arranged correspondingly in a line and have a line direction respectively, the two line directions are parallel to the slide connecting direction.

17. The electronic device according to claim 16, wherein a fixing component is projected out of the sliding slot, the sliding slot has a positioning slot corresponding to the fixing component, and the fixing component is positioned in the positioning slot.

18. The electronic device according to claim 16, wherein the slider has a sliding end and a stopping end oppositely, the slider slides into the sliding slot from the sliding end, an opening is provided at a lateral side of the sliding slot and the stopping end is stopped at the opening, the width of the opening is provided corresponding to the width of the sliding end, and the width of the sliding end is smaller than the width of the stopping end.

19. The electronic device according to claim 16, wherein each conductive pad contacts every elastic conductive terminal in turn.

20. The electronic device according to claim 18, wherein the elastic conductive terminals includes a first grounding terminal, a first power terminal and at least one first data terminal, and the at least one first data terminal is disposed between the first grounding terminal and the first power terminal, the conductive pads include a second grounding terminal, a second power terminal and at least one second data terminal, and the at least one second data terminal is disposed between the second grounding terminal and the second power terminal.

21. The electronic device according to claim 20, wherein when the second power terminal has a voltage, the first power terminal is arranged in a side closing to the sliding end, and the first grounding terminal is arranged in a side closing to the stopped end.

22. The electronic device according to claim 20, wherein when the first power terminal has a voltage, the first power terminal is arranged in a side closing to the stopped end, and the first grounding terminal is arranged in a side closing to the sliding end.

23. The electronic device according to claim 16, wherein the sliding slot further includes a move-over slot, and a depth of the move-over slot is provided corresponding to an exposing out height of the elastic conductive terminals.

* * * * *